US011998041B2

(12) United States Patent
Eusepi et al.

(10) Patent No.: US 11,998,041 B2
(45) Date of Patent: Jun. 4, 2024

(54) METHOD FOR MAKING A SUB-UNIT OF A SMOKING ARTICLE

(71) Applicant: G.D S.P.A., Bologna (IT)

(72) Inventors: Ivan Eusepi, Castelmaggiore (IT); Marco Esposti, Casalecchio di Reno (IT); Gabriele Benni, Sasso Marconi (IT); Giuliano Gamberini, Crevalcore (IT); Luca Federici, Bologna (IT)

(73) Assignee: G.D S.p.A., Bologna (IT)

( * ) Notice: Subject to any disclaimer, the term of this patent is extended or adjusted under 35 U.S.C. 154(b) by 323 days.

(21) Appl. No.: 16/955,728

(22) PCT Filed: Dec. 19, 2018

(86) PCT No.: PCT/IB2018/060311
§ 371 (c)(1),
(2) Date: Jun. 18, 2020

(87) PCT Pub. No.: WO2019/123296
PCT Pub. Date: Jun. 27, 2019

(65) Prior Publication Data

US 2020/0390147 A1 Dec. 17, 2020

(30) Foreign Application Priority Data

Dec. 22, 2017 (IT) ..... 102017000149237

(51) Int. Cl.
*A24D 3/02* (2006.01)
*A24C 5/01* (2020.01)
(Continued)

(52) U.S. Cl.
CPC ..... *A24D 3/0225* (2013.01); *A24C 5/01* (2020.01); *A24C 5/12* (2013.01); *A24C 5/46* (2013.01);
(Continued)

(58) Field of Classification Search
USPC ..... 131/280
See application file for complete search history.

(56) References Cited

U.S. PATENT DOCUMENTS 3,765,423 A 10/1973 Kim
5,666,976 A * 9/1997 Adams et al. ..... A24C 5/00 131/94
6,053,176 A 4/2000 Adams et al.

FOREIGN PATENT DOCUMENTS

DE 102015205768 A1 10/2016
GB 810759 A 3/1959
(Continued)

OTHER PUBLICATIONS

International Search Report and Written Opinion dated May 8, 2019 from counterpart International Patent Application No. PCT/IB2018/060311.
(Continued)

*Primary Examiner* — Christopher M Rodd
*Assistant Examiner* — Ronnie Kirby Jordan
(74) *Attorney, Agent, or Firm* — SHUTTLEWORTH & INGERSOLL, PLC; Timothy J. Klima

(57) ABSTRACT

A method for making a sub-unit of a smoking article, specifically an HNB smoking article, includes preparing a rod segment, of the tobacco industry and wrapping a connecting strip of wrapping material round that rod segment, about a wrapping axis, in such a way that a first portion of the connecting strip is superposed on a first end of the rod segment and a second portion of it is axially protruding from the first end of the rod segment thereby defining a tubular wrapping which encloses a containment chamber. Then a filling material of the tobacco industry is placed inside the containment chamber. The method also includes a step of making a wall, transverse to the wrapping axis, defining an
(Continued)

at least partial closure of the containment chamber, specifically by folding an end portion of the second portion the connecting strip.

10 Claims, 4 Drawing Sheets

(51) Int. Cl.

| | |
|---|---|
| ***A24C 5/12*** | (2006.01) |
| ***A24C 5/46*** | (2006.01) |
| ***A24C 5/54*** | (2006.01) |
| ***A24D 1/02*** | (2006.01) |
| ***A24D 1/22*** | (2020.01) |

(52) U.S. Cl.
CPC ..... *A24C 5/54* (2013.01); *A24D 1/02* (2013.01); *A24D 1/22* (2020.01)

(56) References Cited

FOREIGN PATENT DOCUMENTS

| | | | |
|---|---|---|---|
| KR | 20100072913 | A | 7/2010 |
| KR | 20170001464 | U | 4/2017 |
| WO | 2008059201 | A1 | 5/2008 |
| WO | 2009007258 | A1 | 1/2009 |
| WO | 2009016122 | A1 | 2/2009 |

OTHER PUBLICATIONS

Communication received from the European Patent Office dated Apr. 1, 2021 from counterpart European Patent Application No. 18839620.4.
Communication received from the European Patent Office dated May 13, 2022 from counterpart European Patent Application No. 18839620.4.
European Office Action dated Aug. 6, 2021 from counterpart European Patent Application No. 18839620.4.

* cited by examiner 1
2
2a
3
3a
3b
4
5
5a
5b
5b'
6
C
X

METHOD FOR MAKING A SUB-UNIT OF A SMOKING ARTICLE

This application is the National Phase of International Application PCT/IB2018/060311 filed Dec. 19, 2018 which designated the U.S.

This application claims priority to Italian Patent Application No. 102017000149237 filed Dec. 22, 2017.

TECHNICAL FIELD

This invention relates to a method for making a sub-unit of a smoking article. Specifically, this invention is intended for making a sub-unit of an Heat Not Burn (HNB) type smoking article.

BACKGROUND ART

That type of article may be used by heating, but not burning, the active portion.

The active portion may in fact be a piece comprising an aerosol-generating element, or a heat-not-burn type tobacco containing product.

In this case the tobacco may be for example of the type which is pre-treated, reconstituted, homogenized, or cast leaf, which in particular takes the form of loose material such as pellets or in the form of a crimp cut ribbon.

However, in this context, in order to be able to ensure the quality of the finished product, it is important to guarantee the correct containment and retaining of the active portion, both during the entire production process and after it has been completed.

Prior art production methods involve making a smoking article formed by a rod-shaped body (for example a filter or a heating element) and a tube made of wrapping material which is then filled with the aerosol-generating element.

However, that solution is not very suitable for guaranteeing the integrity of the article in particular because it does not allow correct retaining of the active portion in the tubular body to be ensured.

DISCLOSURE OF THE INVENTION

In this context, the technical purpose which forms the basis of this invention is to propose a method for making a sub-unit of a smoking article which overcomes at least some of the above-mentioned disadvantages of the prior art.

In particular, the aim of this invention is to provide a method for making a sub-unit of a smoking article which allows the structural integrity of the smoking article to be guaranteed, in particular preventing the unwanted escape of the type of active portion used to make its filling.

The technical purpose indicated and the aims specified are substantially achieved by a method for making a sub-unit of a smoking article, comprising the technical features described in one or more of the accompanying claims.

This invention shows a method for making a sub-unit of a smoking article, specifically an HNB smoking article, which comprises preparing a rod segment of the tobacco industry and wrapping a connecting strip of wrapping material round the rod segment about a wrapping axis, in such a way that a first portion of the connecting strip is superposed on a first end of the rod segment and a second portion of it is axially protruding from the first end of the rod segment, thereby defining a tubular wrapping which encloses a containment chamber "C".

Then a filling material of the tobacco industry is placed inside the containment chamber "C".

The method also comprises a step of making a wall, transverse to the wrapping axis, which defines an at least partial closure of the containment chamber "C", preferably by folding an end portion of the second portion of the connecting strip.

Advantageously, this method for making a sub-unit of a smoking article efficiently prevents the filling material from coming out.

This invention also relates to a sub-unit of a smoking article, preferably an HNB smoking article.

That sub-unit comprises a rod segment of the tobacco industry and a connecting strip of wrapping material.

The connecting strip of wrapping material is wrapped round the rod segment about a wrapping axis in such a way that a first portion of the connecting strip is superposed on a first end of the rod segment and a second portion of it is axially protruding from the first end of the rod segment, thereby defining a tubular wrapping which encloses a containment chamber "C" containing a filling material of the tobacco industry.

The sub-unit also has a wall, transverse to the wrapping axis, which defines at least partial closure of the containment chamber "C".

That wall is defined by an end portion of the second portion of the connecting strip.

Advantageously, the structural shape of that article guarantees correct containment of the filling material placed inside it.

The dependent claims, which are incorporated herein by reference, correspond to different embodiments of the invention.

BRIEF DESCRIPTION OF DRAWINGS

Further features and advantages of this invention are more apparent in the indicative, non-limiting description below, with reference to a preferred, but non-exclusive embodiment of a method for making a sub-unit of a smoking article, as illustrated in the accompanying drawings in which.

DETAILED DESCRIPTION OF PREFERRED EMBODIMENTS OF THE INVENTION

In the accompanying figures, in general the numeral 1 denotes a sub-unit of a smoking article, specifically, for example, an Heat Not Burn (HNB) type smoking article.

Figures 2A, 2B, 2C, 3:
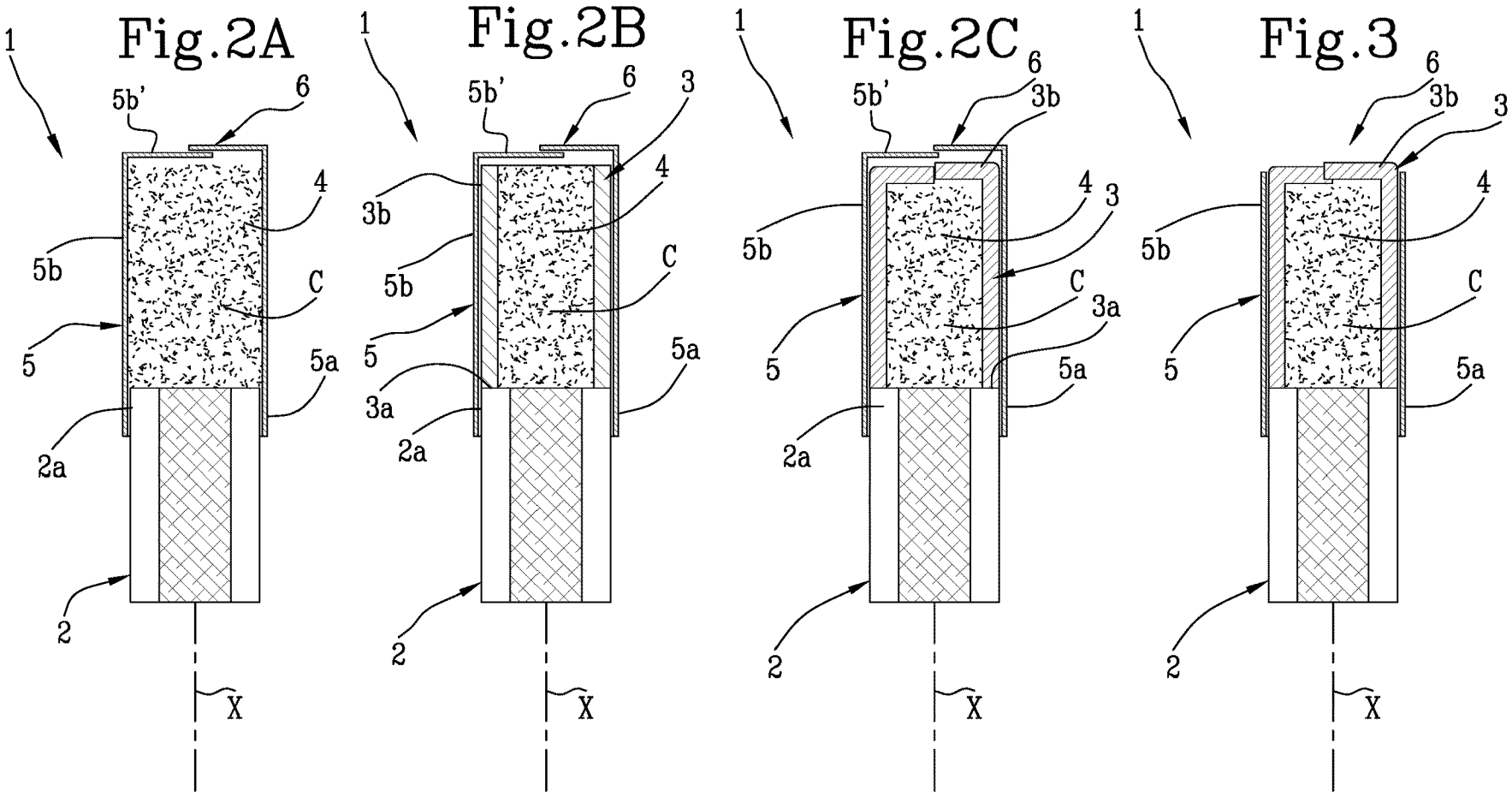
FIGS. 2A, 2B and 2C show respective sub-units for smoking articles made using respective process flows according to the method disclosed by this invention.
FIG. 3 shows a sub-unit for smoking articles made using a further process flow according to this invention.

According to a first possible embodiment, shown in detail in FIG. 2A, the sub-unit 1 comprises a rod segment 2 and a connecting strip 5 of wrapping material wrapped round the rod segment 2.

The rod segment 2 may, for example, be a segment of filtering material, therefore suitable for making a filter of the smoking article, or a heating element configured for allowing the passage inside it of a flow of air and/or another gas and for heating it as it passes, or a tobacco-based piece, or, generically, an aerosol generator.

The connecting strip 5 may be at least partly metallized and/or at least partly made of metallic material, for example aluminium.

Specifically, the connecting strip 5 is wrapped round the rod segment 2 about a wrapping axis "X" in such a way that a first portion 5*a* of the connecting strip is superposed on a first end 2*a* of the rod segment 2 and a second portion 5*b* of it is axially protruding from the first end 2*a* of the rod segment 2, thereby defining a tubular wrapping which encloses a containment chamber "C" containing a filling material 4 of the tobacco industry, such as tobacco which is pre-treated, reconstituted, homogenized, pellets or cast leaf, which may take the form of a crimp cut ribbon or loose material such as small balls or pearls.

The sub-unit 1 also has a wall 6, transverse to the wrapping axis "X", which defines an at least partial, preferably complete, closure of the containment chamber "C".

Preferably, that wall 6 is defined by an end portion 5*b*' of the second portion 5*b* of the connecting strip 5 suitably folded towards the wrapping axis "X".

In other words, the connecting strip 5 has a first portion 5*a* wrapped and joined round the rod segment 2 and a second portion 5*b* which extends beyond the first end 2*a* of that rod segment 2, defining a containment chamber "C" for the filling material 4 which is therefore delimited at its ends, along the wrapping axis "X", respectively by the first end 2*a* of the rod segment 2 and by the wall 6 defined by the end portion 5*b*' of the second portion 5*b* of the connecting strip 5 and laterally by the remainder on the second portion 5*b* side which does not define the wall 6.

Moreover, the connecting strip 5 has a layer of adhesive applied only on its first end 5*a*, that is to say, the connecting strip 5 has a layer of adhesive which allows it to adhere to the lateral wall of the rod segment 2, whilst the second portion 5*b* is free of that layer of adhesive, specifically the end portion 5*b*' is free of the layer of adhesive, in such a way that the wall 6 does not have that adhesive material on it.

Preferably, to improve product stability, the connecting strip 5 is a double connecting strip 5, that is to say, it is made by wrapping two connecting strips 5 which are superposed.

According to a further possible embodiment, shown in detail in FIG. 2*b*, the sub-unit 1 also comprises a hollow tubular segment 3 having a first end 3*a* disposed in contact, in particular abutting, against the first end 2*a* of the rod segment 2.

According to that embodiment, the connecting strip 5 is wrapped round the rod segment 2 about a wrapping axis "X" in such a way that the first portion 5*a* of the connecting strip is superposed on the first end 2*a* of the rod segment 2 and its second portion 5*b* is superposed on the tubular segment 3 to define therewith a tubular wrapping enclosing the containment chamber "C" containing the filling material 4.

The connecting strip 5 also has the end portion 5*b*' axially protruding from a second end 3*b* of the tubular segment 3.

That end portion 5*b*' defines the wall 6 which defines an at least partial closure of the containment chamber "C".

In other words, the rod segment 2 and the tubular segment 3 are stably connected and joined by means of the connecting strip 5 of wrapping material which is wrapped round them.

Preferably, relative to both of the embodiments described above, to facilitate its folding, the end portion 5*b*' has radial score lines or radial fold lines disposed in such a way as to provide easy fold lines along which to fold the protruding portion 5*b*' to define the wall 6.

According to one particular aspect of this invention, the end portion 5*b*' which defines the wall 6 is made of material which is naturally porous or rendered porous by making holes or perforations in it, for example by means of laser, electrostatic, plasma perforation, in order to improve its air or gas permeability, for allowing correct inflow of air to the filling material 4 or outflow of smoke produced from it.

In other words, the end portion 5*b*' has features such that it easily allows, that it to say, without opposing it, the passage of a flow of air or gas through the wall 6, therefore allowing that flow to reach and pass through the filling material 4 contained in the containment chamber "C".

According to a further possible embodiment, shown in detail in FIG. 2C, the wall 6 is defined by folding towards the wrapping axis "X" both the end portion 5*b*' of the connecting strip 5 and the second end 3*b* of the tubular segment 3.

In other words, the second end 3*b* of the tubular segment 3 is folded towards the wrapping axis "X" and the end portion 5*b*' of the connecting strip 5 is superposed on it, in such a way that the wall 6 is defined by superposing these two elements, with the second end 3*b* of the tubular segment 3 towards the inside of the containment chamber "C", whilst the end portion 5*b*' of the connecting strip 5 is towards the outside of it.

According to that embodiment, the second end 3*a* of the tubular segment 3, that is to say the end which defines the wall 6, is also made of material which is naturally porous or rendered porous by making holes or perforations in it, for example by means of laser, electrostatic, plasma perforation, in order to improve its air or gas permeability, for allowing correct inflow of air to the filling material 4 or outflow of smoke produced from it.

In other words, the second end 3*a* of the tubular segment 3 has features such that it easily allows, that it to say, without opposing it, the passage of a flow of air or gas through the wall 6, therefore allowing that flow to reach and pass through the filling material 4 contained in the containment chamber "C".

According to a further possible embodiment, shown in detail in FIG. 3, the wall 6 is defined by folding towards the wrapping axis "X" only the second end 3*b* of the tubular segment 3. In this case, the connecting strip 5 is only used for connecting the rod 2 and the tubular segment 3. Therefore, the tubular segment 3 will be made so that the second end 3*b*, that is to say, the wall 6, has features such that it easily allows, that it to say, without opposing it, the passage of a flow of air or gas through the wall 6 itself, therefore allowing that flow to reach and pass through the filling material 4 contained in the containment chamber "C".

This invention also relates to a method for making a sub-unit 1 of a smoking article, specifically an HNB smoking article.

Figure 1A:
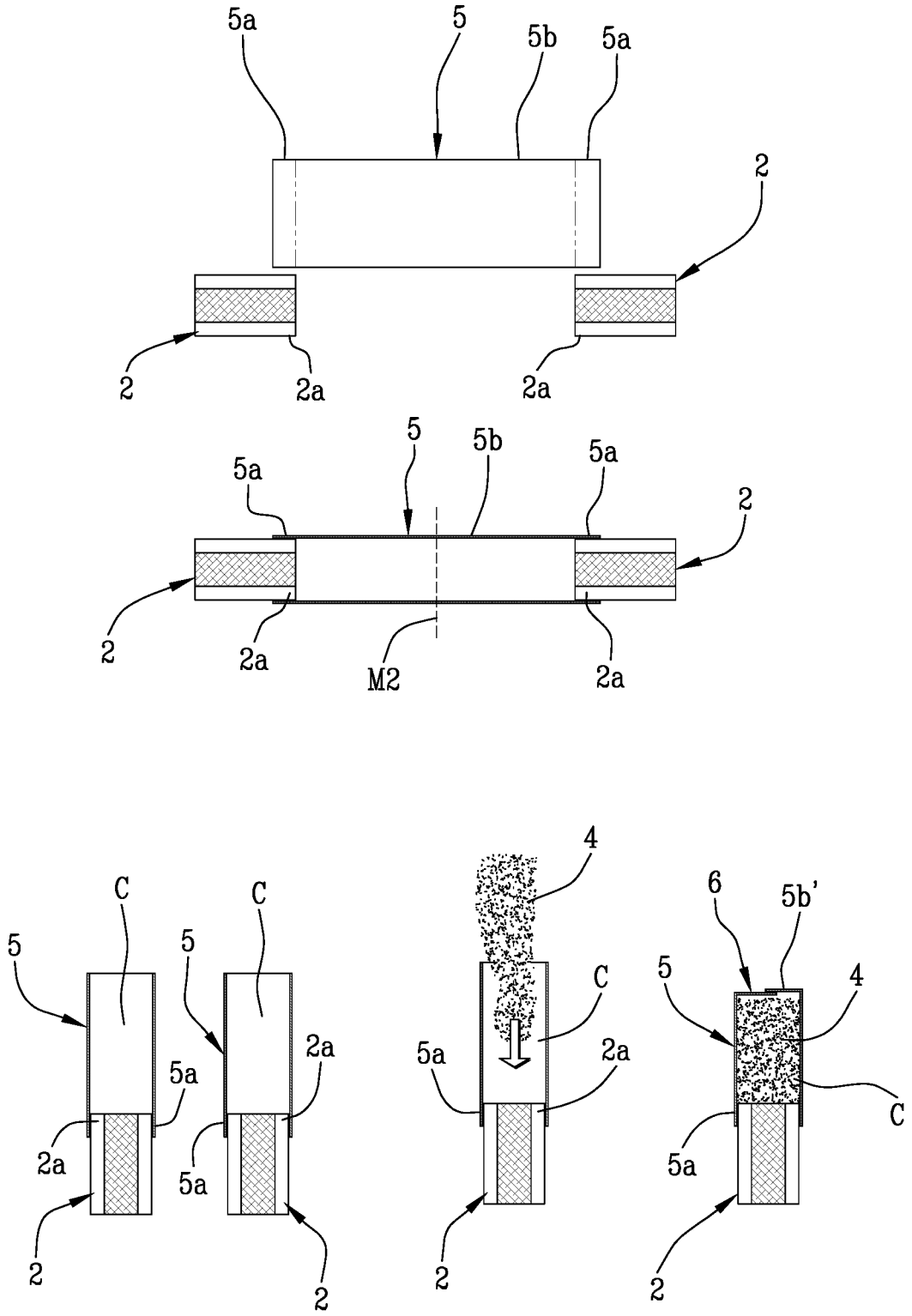
FIGS. 1A, 1B and 1C show possible embodiments of a process flow for making a sub-unit of a smoking article.

As shown in detail in FIG. 1A, the method according to this invention comprises preparing a rod segment 2 of the tobacco industry and wrapping a connecting strip 5 of wrapping material round the rod segment 2 about a wrapping axis "X", in such a way that a first portion 5*a* of that connecting strip 5 is superposed on a first end 2*a* of the rod segment 2 and a second portion 5*b* of the connecting strip 5 is axially protruding from the first end 2*a* of the rod segment 2 to define a tubular wrapping which encloses a containment chamber "C".

According to what is discussed above, the step of preparing a rod segment 2 may be accomplished for example by preparing a heating segment for HNB or a filter segment or tobacco segment or an aerosol generating segment.

Once the containment chamber "C" has been made, a filling material 4 of the tobacco industry is placed inside it, as already indicated that filling material 4 may be tobacco which is pre-treated, reconstituted, homogenized, or cast leaf which may take the form of a crimp cut ribbon or loose material such as small balls.

The method also comprises a step of folding an end portion 5*b*' of the second portion 5*b* of the connecting strip 5 to make a wall 6, transverse to the wrapping axis "X", which defines an at least partial closure of the containment chamber "C".

In other words, the end portion 5*b*' of the connecting strip 5 is folded in such a way as to at least party close the containment chamber which is therefore delimited at its ends jointly by the first end 2*a* of the rod segment 2 and by the end portion 5*b*' of the connecting strip 5, whilst the remaining part of the second portion 5*b* of the connecting strip 5 delimits its lateral surface.

In that way it is possible to guarantee correct and secure containment of the filling material 4 by preventing any possible accidental loss of filling material from the containment chamber "C".

Figure 1B:
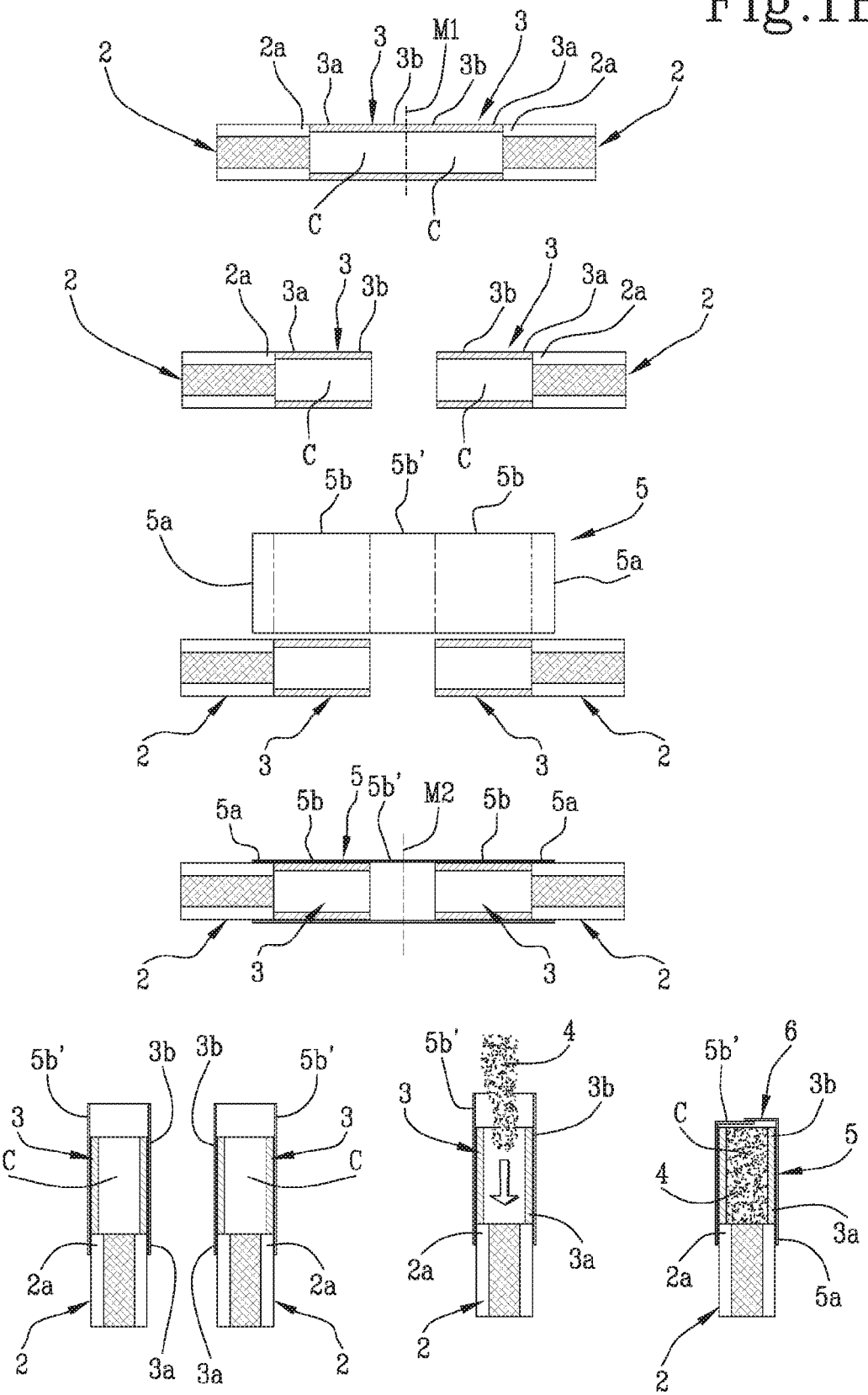

According to one possible alternative embodiment, shown in detail in FIG. 1B, the method according to this invention also comprises preparing a hollow tubular segment 3 in a reciprocal abutting configuration with the rod segment 2 of the tobacco industry at respective first ends 2*a*, 3*a*.

That reciprocal positioning of the rod segment 2 and the tubular segment 3 defines a semi-finished product of the tobacco industry which has an access opening at the second end 3*b* of the tubular segment 3.

Then the connecting strip 5 of wrapping material is wrapped round the rod segment 2 and the tubular segment 3, joining them to each other.

In other words, the connecting strip 5 allows the rod segment 2 and the tubular segment 3 to be stably connected to each other, in such a way that the connecting strip 5 has its first portion 5*a* superposed on a first end 2*a* of the rod segment 2*a* and its second portion 5*b* superposed on the tubular segment 3 to define therewith a tubular wrapping enclosing the containment chamber "C" and the end portion is axially protruding from a second end 3*b* of the tubular segment 3.

As already indicated for the preceding embodiment, once the containment chamber "C" has been filled, the end portion 5*b*' of the connecting strip 5 is folded towards the wrapping axis "X" to make the wall 6 which defines an at least partial closure of the containment chamber "C".

Preferably, the length of the end portion 5*b*' along the wrapping axis "X" is between 1 and 10 mm, preferably that length is in any case sufficient, when that end portion 5*b*' is folded, to generate a wall which defines an at least partial or complete closure of the containment chamber "C".

Figure 1C:
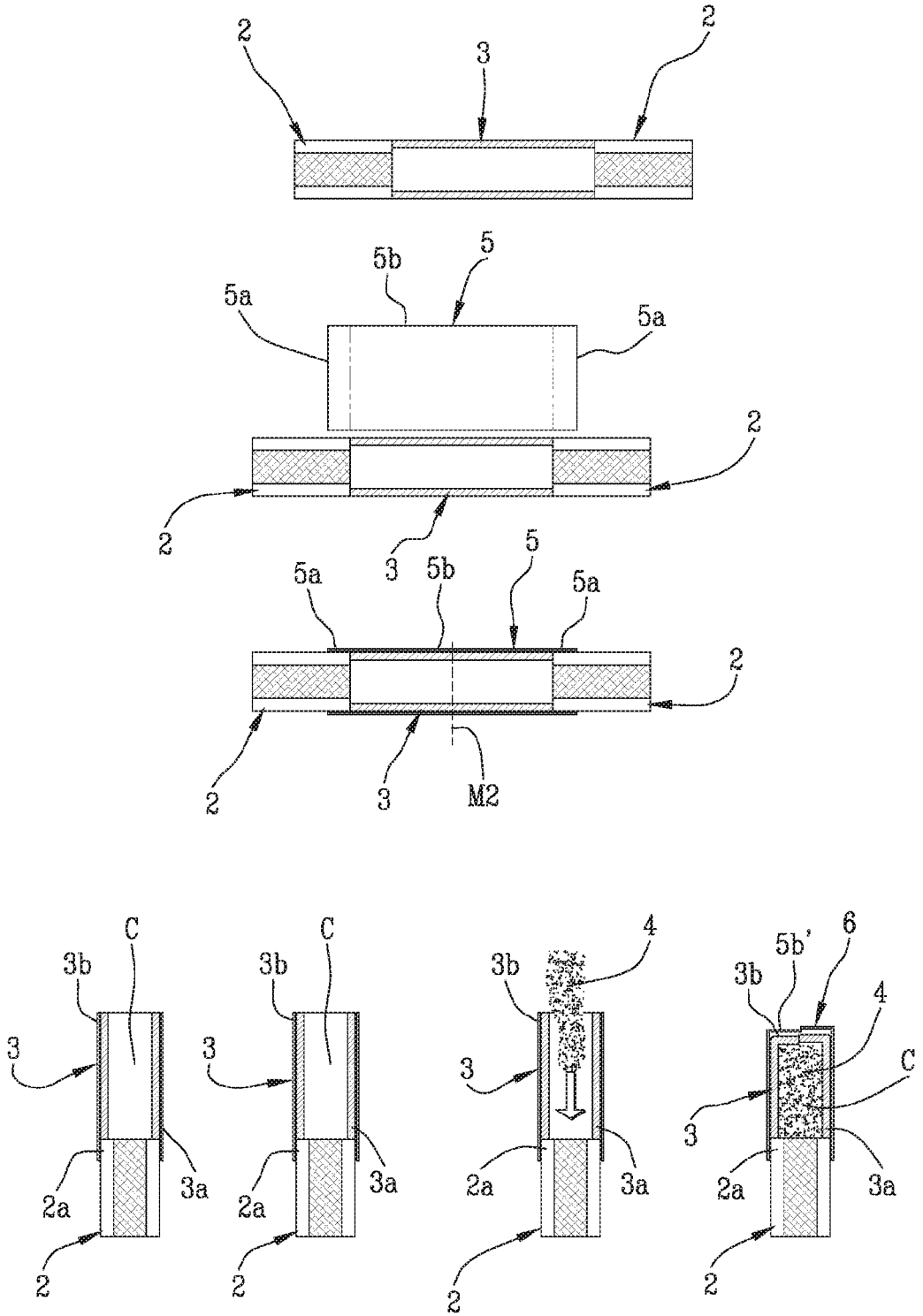

According to a further possible embodiment of the method according to this invention, shown in more detail in the accompany FIG. 1C, the connecting strip 5 is wrapped round the rod segment 2 and the tubular segment 3 in such a way that the connecting strip 5 has its first portion 5*a* superposed on a first end 2*a* of the rod segment 2*a* and its second portion 5*b* superposed on the tubular segment 3 to define therewith a tubular wrapping enclosing the containment chamber "C" and the end portion is superposed on the second end 3*b* of the rod segment 3.

According to that particular embodiment the step of folding the end portion 5*b*' of the second portion 5*b* of the connecting strip 5 also involves simultaneously also folding the second end 3*b* of the tubular segment 3 in such a way that the second portion 3*b* contributes to making the wall 6, transverse to the wrapping axis "X", which defines the at least partial closure of the containment chamber "C".

In general, in all of the embodiments of the method described above there may be a step of making a plurality of score lines or easy fold lines in the end portion 5*b*' of the connecting strip 5.

Those score lines or easy fold lines facilitate folding over the end portion 5*b*' towards the wrapping axis "X".

Preferably, this step of making the plurality of score lines or easy fold lines is performed before wrapping the connecting strip 5 round the rod segment 2 and/or the tubular segment 3.

The method according to this invention also comprises a step of increasing the air and/or gas permeability of the end portion 5*b*', for example by making holes or perforations by means of laser, electrostatic, plasma perforation.

That procedure allows improvement of the air or gas permeability of the end portion 5*b*', for allowing correct inflow of air to the filling material 4 or outflow of smoke produced from it through the containment chamber "C".

According to the embodiment shown in FIG. 1C, that is to say, in which the wall 6 is made by superposing the end portion 5*b*' of the connecting strip 5 on the second end 3*b* of the tubular segment 3 (which is therefore also itself folded towards the wrapping axis "X"), advantageously the second end 3*b* of the tubular segment 3 is also made of material which is naturally porous or rendered porous by making holes or perforations in it, for example by means of laser, electrostatic, plasma perforation, in order to improve its air or gas permeability, for allowing correct inflow of air to the filling material 4 or outflow of smoke produced from it through the containment chamber "C".

According to a particular aspect of this invention, the step of simultaneously wrapping both of the rod segments with a single connecting strip comprises a set of sub-steps which allow simultaneous processing and production of a pair of sub-units 1.

In particular the step of preparing the rod segment 2 comprises a sub-step of preparing a pair of facing rod segments 2 aligned along the wrapping axis "X" and the step of wrapping a connecting strip 5 of wrapping material round the rod segment 2 comprises the sub-steps of: simultaneously wrapping both rod segments 2 with a single connecting strip 5 while at the same time keeping the rod segments axially spaced from each other and cutting the connecting strip 5, wrapped round the rod segments 2, preferably along a midplane "M2" of it.

Specifically, the sub-step of simultaneously wrapping both rod segments 2 with a single connecting strip 5 comprises preparing a double-length tubular segment 3 inserted between two rod segments 2.

Then cutting that double-length tubular segment 3 along a midplane "M1" of it, thus obtaining two semi-finished products of the tobacco industry abutting end to end at the cutting line "M1".

Each semi-finished product is defined by a rod segment 2 and is in a reciprocal abutting configuration with the tubular segment 3 at respective first ends 2*a*, 3*a*.

Then the semi-finished products are spaced apart along an axial direction, which coincides with the wrapping axis "X".

Specifically, the semi-finished products are spaced by a distance of between 2 and 40 mm.

In this way, when proceeding with the steps of the method of simultaneously wrapping both rod segments 2 with a single connecting strip 5 while at the same time keeping the rod segments axially spaced from each other, a chamber is created interposed between the second ends 3*b* of the tubular segments 3 of the two semi-finished products and defined by those two second ends 3*b* and laterally by the end portion 5*b*' of the connecting strip 5.

Then, in each of the scenarios described above the filling material 4 is placed inside both of the containment chambers "C" and then the end portion 5*b*' of the connecting strip 5 is folded to obtain at least partial closure of the containment chamber "C".

According to a further aspect, it is possible to not perform the step of spacing the semi-finished products apart along an axial direction, in such a way that the end portion 5*b*' of the connecting strip 5 is entirely superposed on the second end 3*b* of the tubular segment 3.

According to that aspect, after placing the filling material 4 inside both of the containment chambers "C", the second end 3*b* of the tubular segment 3 and the end portion 5*b*' of the connecting strip 5 which is superposed on it are simultaneously folded.

Advantageously, this invention achieves the preset aims by overcoming the disadvantages of the prior art by making available to the user a sub-unit 1 of a smoking article and the related method for making it which allow correct containment of the filling material 4 to be guaranteed.

The invention claimed is:

1. A method for making a sub-unit of an HNB smoking article, comprising the steps of:

preparing a rod segment of the tobacco industry, wherein the rod segment comprises at least one chosen from a filtering material, suitable for making a filter of the smoking article, a heating element configured for allowing passage of a flow of air and/or another gas for heating, a tobacco-based element, and an aerosol generator;

wrapping a connecting strip of wrapping material around the rod segment about a wrapping axis such that a first portion of the connecting strip is superposed on a first end of the rod segment and a second portion of the connecting strip is axially protruding from the first end of the rod segment to define a tubular wrapping enclosing a containment chamber;

after the wrapping step, placing a filling material of the tobacco industry inside the containment chamber by partial filling the containment chamber to leave an end portion of the tubular wrapping end free to form a closing wall;

making the closing wall, transverse to the wrapping axis, defining an at least partial closure of the containment chamber, specifically by folding an end portion of the second portion of the connecting strip.

2. The method according to claim 1, wherein the step of wrapping the connecting strip of wrapping material around the rod segment is carried out in the following sub-steps:

preparing a hollow tubular segment having a first end disposed in an abutting configuration against the rod segment at the first end of the rod segment;

wrapping the connecting strip of wrapping material around the rod segment and around the tubular segment, thereby joining the rod segment to the tubular segment such that the first portion of the connecting strip is superposed on the first end of the rod segment and the second portion of the connecting strip is superposed on the tubular segment to define therewith the tubular wrapping enclosing the containment chamber.

3. The method according to claim 1, wherein the step of folding the end portion makes a wall that completely covers the containment chamber.

4. The method according to claim 3, wherein the length of the end portion, along the wrapping axis, is between 1 and 10 mm.

5. The method according to claim 3, and further comprising a step of making a plurality of score lines or easy fold lines in the end portion of the connecting strip to facilitate folding the end portion.

6. The method according to claim 3, and further comprising a step of increasing an air and/or gas permeability of the end portion, by making a plurality of holes or perforations in the end portion.

7. The method according to claim 1, wherein the step of preparing a rod segment is accomplished by preparing a heating segment for the HNB smoking article or a filter or tobacco segment or an aerosol generating segment.

8. The method according to claim 1, wherein the step of preparing the rod segment comprises preparing a pair of facing rod segments aligned along the wrapping axis; and the step of wrapping the connecting strip of wrapping material around the rod segment comprises the following sub-steps:

simultaneously wrapping both rod segments with a single one of the connecting strip while the rod segments are kept axially spaced from each other;

cutting the connecting strip wrapped round the rod segments, along a midplane of the connecting strip.

9. The method according to claim 8, wherein the step of simultaneously wrapping both rod segments with the single one of the connecting strip comprises the following sub-steps:

preparing a double-length tubular segment inserted between two rod segments of the tobacco industry;

cutting the double-length tubular segment along a midplane of the double-length tubular segment, thus obtaining two semi-finished products of the tobacco industry abutting end to end at the midplane of the double-length tubular segment;

spacing the two semi-finished products apart along an axial direction coinciding with the wrapping axis.

10. The method according to claim 1, wherein the step of making the wall, transverse to the wrapping axis, defining the at least partial closure of the containment chamber is carried out by folding an end position of the second portion of the connecting strip.

* * * * *